US007395922B1

(12) United States Patent
Sinha

(10) Patent No.: US 7,395,922 B1
(45) Date of Patent: Jul. 8, 2008

(54) CONTAINER FOR GRENADES

(75) Inventor: Yash Sinha, Trenton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 504 days.

(21) Appl. No.: 11/162,129

(22) Filed: Aug. 30, 2005

Related U.S. Application Data

(60) Provisional application No. 60/522,301, filed on Sep. 14, 2004.

(51) Int. Cl.
*F42B 39/14* (2006.01)

(52) U.S. Cl. ..... 206/3; 206/523; 206/593; 206/585; 206/589

(58) Field of Classification Search ..... 206/3, 206/523, 585, 588, 589, 591, 593, 594; 89/34
See application file for complete search history.

(56) References Cited

U.S. PATENT DOCUMENTS 2,750,028 A * 6/1956 Bode et al. ..... 206/3
5,158,173 A * 10/1992 Halsey et al. ..... 206/3
6,865,977 B1 * 3/2005 Kim et al. ..... 86/50

* cited by examiner

*Primary Examiner*—Jacob K Ackun, Jr.
(74) *Attorney, Agent, or Firm*—John F. Moran

(57) ABSTRACT

A grenade container includes a box having a bottom and four sides; a first foam layer disposed on the bottom of the box; a second foam layer disposed on the first foam layer and having a plurality of openings formed therein for receiving grenades; a plurality of grenades placed in the openings in the second foam layer; a first partition disposed on the grenades placed in the openings in the second foam layer; a third foam layer disposed above the first partition and having a plurality of openings formed therein for receiving grenades; a plurality of grenades placed in the openings in the third foam layer; a second partition disposed on the grenades placed in the openings in the third foam layer; a fourth foam layer disposed above the second partition; and a lid and a latch for closing the box.

15 Claims, 3 Drawing Sheets

CONTAINER FOR GRENADES

CROSS-REFERENCE TO RELATED APPLICATIONS

This application claims the benefit under 35 USC 119(e) of U.S. provisional patent application 60/552,301 filed on Sep. 14, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to grenades and in particular to packaging for grenades.

The known packaging system for grenades, in particular smoke grenades, comprises 16 spiral-bound fiber containers packed into a wire-bound wood ammunition crate. Each of the 16 spiral-bound fiber containers contains a single grenade. Several of the wood ammunition crates are stacked on a pallet and secured thereto. To access a grenade, a soldier has to unpalletize the wood crate, open the wood crate, remove the spiral-bound fiber containers, remove the grenades from the spiral bound containers and then load the grenades into individual metal cans or cargo pockets. The total weight of the packaging materials (spiral-bound fiber containers and wood ammunition crate) is about 35 pounds. The known packaging system is heavy and does not meet all performance requirements.

The wood crate does not have any carrying handles or a lid that can be easily opened and shut. The crate is opened by removing some of the wood slats that form the crate. Removing the wood slats often damages them. To close the crate, the wood slats, if still intact, must be fastened to the rest of the crate with nails or similar fasteners. After removal from the pallet, the crate is not easily transportable because it has no carrying handles. Often, the crate is opened and some but not all the grenades are removed, and then the crate is left open. Even if stored in a building, the open crates may allow undesired substances to contact the spiral bound containers.

In particular, the current spiral-bound containers absorb water vapor and cause rust at the metal sealing at the top of the grenade. This rusting can cause the grenades to become "duds." The known packaging is very heavy, bulky and has two layers, i.e., the wood ammunition crate and the spiral-bound fiber containers. The two-layer packaging system is prohibitive in terms of weight and ease of handling.

SUMMARY OF THE INVENTION

One embodiment of the invention is a grenade container comprising a box having a bottom and four sides; a first foam layer disposed on the bottom of the box; a second foam layer disposed on the first foam layer and having a plurality of openings formed therein for receiving grenades; a plurality of grenades placed in the openings in the second foam layer; a first partition disposed on the grenades placed in the openings in the second foam layer; a third foam layer disposed above the first partition and having a plurality of openings formed therein for receiving grenades; a plurality of grenades placed in the openings in the third foam layer; a second partition disposed on the grenades placed in the openings in the third foam layer; a fourth foam layer disposed above the second partition; and a lid and a latch for closing the box.

The present invention provides all the benefits of protection as the known packaging and exceeds the environmental protection required for shipping from depots to the field. The present invention reduces the two-layer system to one layer. The new one layer system allows soldiers to carry grenades in the shipping box wherever they want to go and still have the flexibility to carry one or two grenades in each soldier's personal space. Because of its size, weight, carrying handles and reclosable lid with latch, the new shipping box may be loaded directly into a soldier's vehicle, which is much faster than removing grenades out of the old wire-bound wood crate and loading them individually in a vehicle.

The reclosable lid with latch makes the new package better for long-term storage of grenades and reduces the rust/corrosion of the grenades during storage. The new packaging is cheaper and lighter. The new packaging eases logistics burdens and increases the number of rounds per pallet. In addition, the new packaging affords a stable "side by side" container set up in a palletized configuration. The new packaging is easier to transport. When a mission requires several grenades or more, the soldiers do not have to open a wooden ammunition crate and carry the single spiral-bound containers. Rather, because of the light weight of the new packaging, the soldiers can simply transport the grenades in the new packaging.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
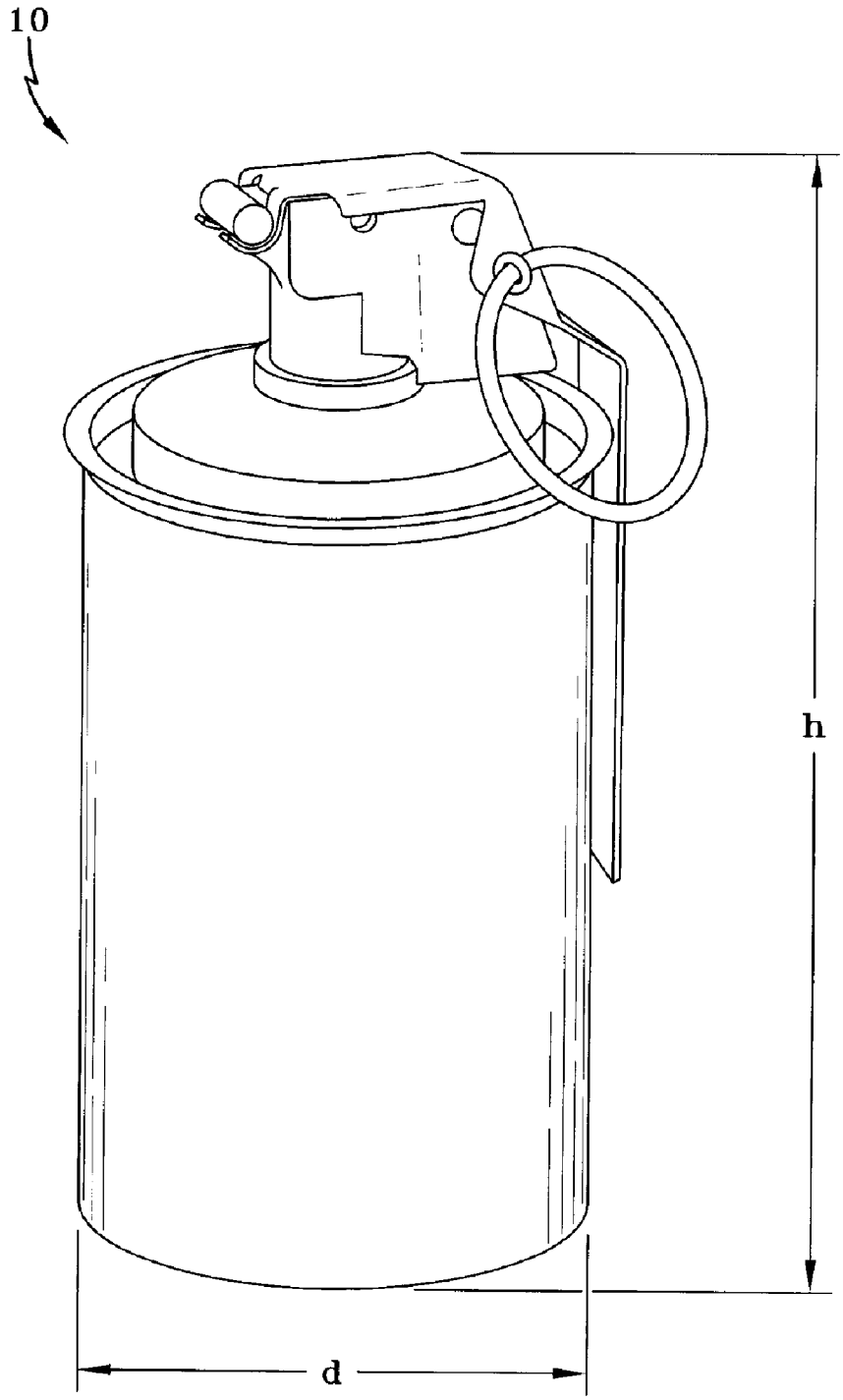
FIG-1 PRIOR ART
FIG. 1 shows a known grenade.

FIG. 1 shows a known grenade 10 having a diameter d and a height h. In one embodiment of the invention, the grenade 10 is a smoke grenade having a diameter d of about 2.5 inches and a height h of about 5.75 inches. The present invention is a container for holding a plurality of grenades 10.

Figure 2:
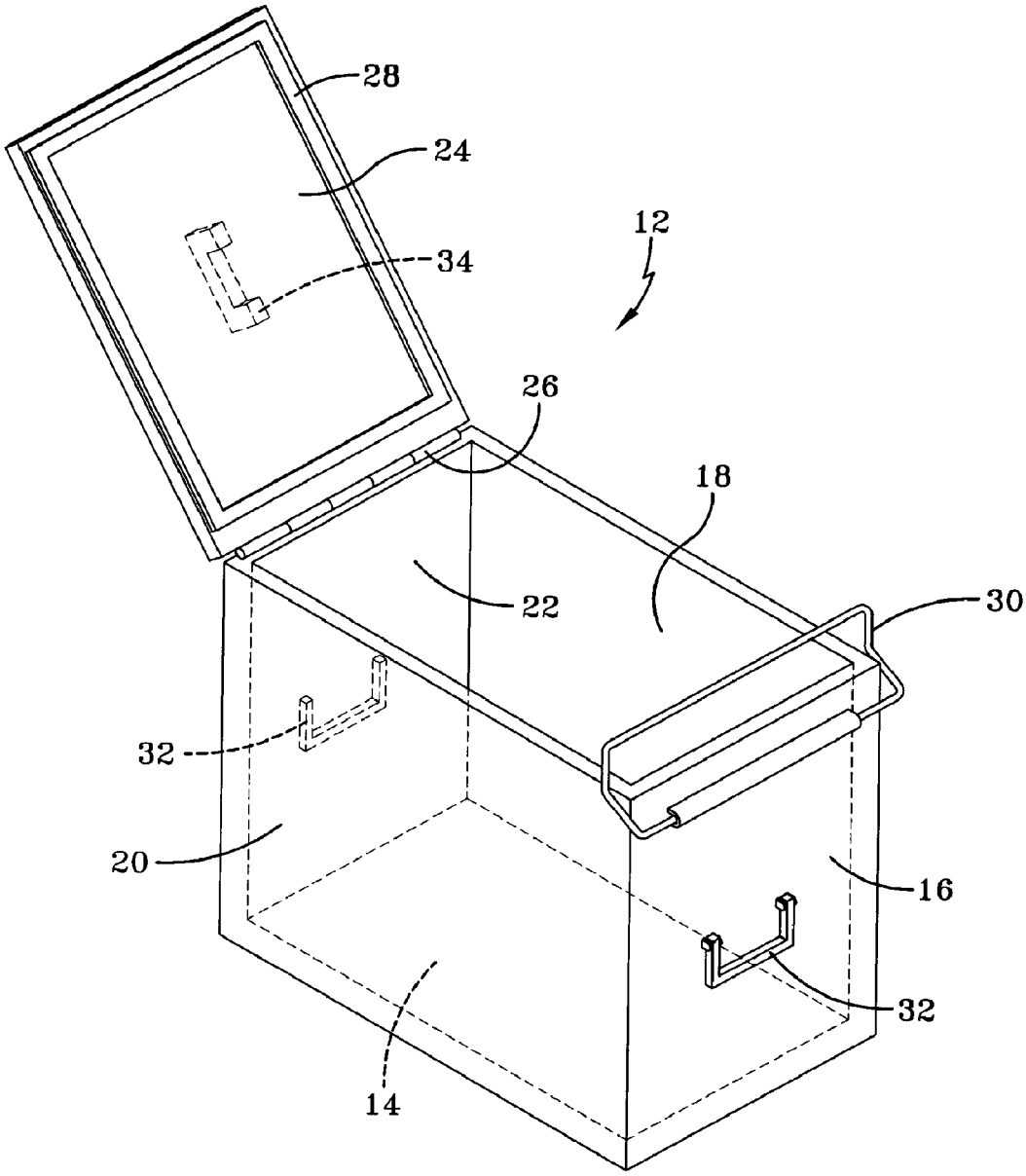
FIG. 2 is a perspective view of a box.

The grenade container includes a box 12 (FIG. 2) having four sides 16, 18, 20, 22, a bottom 14 and a lid 24. The lid 24 is preferably attached to the box 12 using, for example, a hinge 26. A latch 30 attached to an opposite end of the box 12 from the hinge 26 secures the lid 24 to the box 12. A gasket 28 may be used to further seal the box 12. One or more handles are attached to the box 12, for example, a handle 34 on the lid 24 and handles 32 disposed on opposite ends 16, 22 of the box 12.

Box 12 may be made of, for example, metal or a composite material. An exemplary metal is one half-inch cold rolled steel per ASTM-A109 or ASTM-A568. The metal should be painted with corrosion resistant, fire-retardant paint. An example of a composite material is a carbon fiber composite with 40 percent resin and 60 percent carbon fiber. Gasket 28 is preferably neoprene.

Figure 3:
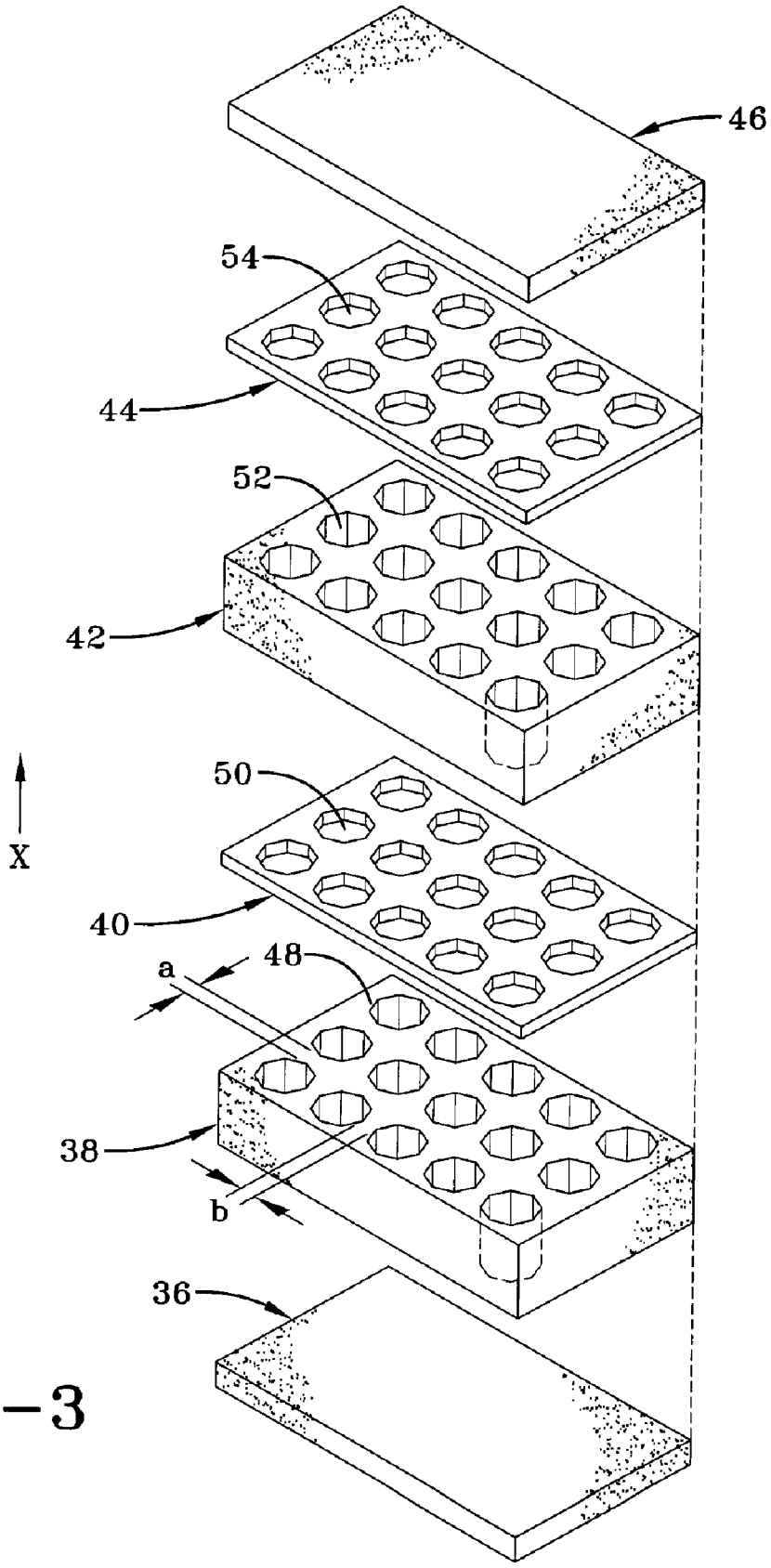
FIG. 3 is an exploded view of the contents of the box.

FIG. 3 shows an exploded view of the contents of the container, excluding grenades 10. A first foam layer 36 is disposed on the bottom of the box 12. A second foam layer 38 is disposed on the first foam layer 36. Second foam layer 38 includes a plurality of openings 48 formed therein for receiving grenades 10. The openings 48 do not extend completely through the thickness of second foam layer 38. Grenades 10 are placed in the openings 48 in the second foam layer 38. A first partition 40 is disposed on the grenades 10 placed in the openings 48 in the second foam layer 38. A third foam layer 42 is disposed above the first partition 40. Third foam layer 42 includes a plurality of openings 52 formed therein for receiving grenades 10. The openings 52 do not extend completely through the thickness of third foam layer 42. Grenades 10 are placed in the openings 52 in the third foam layer 42. A second partition 44 is disposed on the grenades 10 placed in the openings 52 in the third foam layer 42. A fourth foam layer 46 is disposed above the second partition 44.

The first, second, third and fourth foam layers 36, 38, 42, 46 comprise, for example, polyethylene foam having a four-pound density. Preferably, the polyethylene foam has a compression strength of 315 psi (2.17 Mpa) and a tensile strength of 180 psi (1.24 Mpa). The four foam layers are generally rectangular in shape with a length and a width sized to fit snugly in box 12. The first and fourth layers 36, 46 may have the same thickness (in the X direction shown in FIG. 3), for example, about one inch. The second and third foam layers 38, 42 may also have the same thickness, which is preferably at least about twice the thickness of the first and fourth foam layers, 36, 46. In one embodiment, the thickness of the second and third foam layers 38, 42 is about three inches.

Second and third foam layers 38, 42 include openings 48, 52 formed therein. The openings 48, 52 are preferably octagonal in shape and extend, for example, about two-thirds through the thickness of the second and third layers 38, 42. The spacings a and b between adjacent openings in layers 38, 42 is preferably at least about 0.3 inches. The first and fourth foam layers 36, 46 do not have openings.

First and second partitions 40, 44 have openings 50, 54 formed therein for receiving grenades 10. The openings 50, 54 extend completely through partitions 40, 44 and are preferably octagonal in shape. The partitions 40, 44 are made of, for example, thick corrugate cardboard with a thickness from about one eighth of an inch to about one half an inch. The spacings between adjacent openings in first and second partitions 40, 44 is the same as the spacings a and b between adjacent openings in the second and third foam layers. The openings 50, 54 in the first and second partitions 40, 44 contact grenades 10 at a top portion of the grenade, approximately where the fuze is attached to the cylindrical body.

In one embodiment, the box 12 is about 14.5 inches long by about 9 inches wide and about 14.5 inches high. First and fourth foam layers 36, 46 are about one inch thick. Second and third foam layers 38, 42 are about three inches thick and first and second partitions 40, 44 are about one half inch thick. The second and third foam layers 38, 42 and the first and second partitions 40, 44 each have fifteen openings formed therein (5 rows and 3 columns), each opening having a diameter of about 2.5 inches. Fifteen grenades 10 are placed in the openings 48 in second foam layer 38 and fifteen grenades 10 are placed in the openings 52 in third foam layer 42.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A grenade container, comprising:

a box having a bottom and four sides;

a first foam layer disposed on the bottom of the box;

a second foam layer disposed on the first foam layer and having a plurality of openings formed therein for receiving grenades;

a plurality of grenades placed in the openings in the second foam layer;

a first partition disposed on the grenades placed in the openings in the second foam layer;

a third foam layer disposed above the first partition and having a plurality of openings formed therein for receiving grenades;

a plurality of grenades placed in the openings in the third foam layer;

a second partition disposed on the grenades placed in the openings in the third foam layer;

a fourth foam layer disposed above the second partition; and a lid and a latch for closing the box.

2. The container of claim 1 wherein the first, second, third and fourth foam layers comprise polyethylene foam having a four pound density.

3. The container of claim 1 wherein the first and fourth foam layers have a same thickness and the second and third foam layers have a same thickness that is at least twice the thickness of the first and fourth layers.

4. The container of claim 1 further comprising a hinge that attaches the lid to one side of the box wherein the latch secures the lid to an opposite side of the box.

5. The container of claim 1 further comprising at least one handle attached to the box.

6. The container of claim 1 wherein the box and lid are made of metal.

7. The container of claim 1 wherein the box and lid are made of a composite material.

8. The container of claim 7 wherein the composite material comprises about 40 percent resin and about sixty percent carbon fiber.

9. The container of claim 1 wherein the first and second partitions include openings therein for receiving grenades.

10. The container of claim 9 wherein the openings have an octagonal shape.

11. The container of claim 1 wherein the openings in the second and third foam layers have an octagonal shape.

12. The container of claim 1 wherein a spacing between openings in the second foam layer and a spacing between openings in the third foam layer is at least about 0.3 inches.

13. The container of claim 1 wherein a thickness of the first foam layer and a thickness of the fourth foam layer is about one inch.

14. The container of claim 6 wherein the metal is steel having a thickness of about one half inch.

15. The container of claim 5 wherein the at least one handle comprises three handles, one handle located on top of the lid and two handles located on opposite sides of the box.

* * * * *